US009835422B2

(12) United States Patent
Zheng et al.

(10) Patent No.: US 9,835,422 B2
(45) Date of Patent: Dec. 5, 2017

(54) KIND OF IMAGE-TEXT FIREWORK PRODUCTION METHOD

(71) Applicant: SUZHOU Zhengzhihun patent Technology Service Co., Ltd, Suzhou (CN)

(72) Inventors: Maode Zheng, Xinghua (CN); Qiaoyun Chen, Xinghua (CN)

(73) Assignee: Suzhou Zhengzhihun Patent Technology Service Co., Ltd., Suzhou (CN)

( * ) Notice: Subject to any disclaimer, the term of this patent is extended or adjusted under 35 U.S.C. 154(b) by 2 days.

(21) Appl. No.: 14/889,148

(22) PCT Filed: Apr. 11, 2014

(86) PCT No.: PCT/CN2014/075189

§ 371 (c)(1),
(2) Date: Nov. 5, 2015

(87) PCT Pub. No.: WO2014/180216

PCT Pub. Date: Nov. 13, 2014

(65) Prior Publication Data

US 2017/0052005 A1 Feb. 23, 2017

(30) Foreign Application Priority Data

May 7, 2013 (CN) ..... 2013 1 0165414

(51) Int. Cl.
*F42B 4/06* (2006.01)
*F42B 4/10* (2006.01)
(Continued)

(52) U.S. Cl.
CPC ..... *F42B 4/10* (2013.01); *F42B 4/06* (2013.01); *F42B 4/18* (2013.01); *F42B 4/30* (2013.01)

(58) Field of Classification Search
CPC ..... F42B 4/10; F42B 4/06; F42B 4/18; F42B 4/30
(Continued)

(56) References Cited

U.S. PATENT DOCUMENTS 5,954,563 A * 9/1999 Spriggs ..... F42B 4/22 102/357
6,324,981 B1 * 12/2001 Siegler ..... C06B 45/00 102/336
(Continued)

*Primary Examiner* — Samir Abdosh
(74) *Attorney, Agent, or Firm* — Platinum Intellectual Property LLP

(57) ABSTRACT

The present invention comprises a pattern-character firework carrier (101), a pattern-character display method, and a pattern-character firework setting-off step. The pattern-character firework carrier (101) is provided with a lifting-off device (201) which is provided with a lifting-off gunpowder bin (1) with lifting-off gunpowder (6) packaged inside, and a pattern-character display control device (301) which is provided with a lattice gunpowder packaging body (2) provided with a firework launching unit (4) and a simultaneous ignition bin (3). The pattern-character display method comprises steps of designing a pattern, converting the pattern into a color lattice graphic (12), arranging fireworks according to the graphic, loading the fireworks, and the like. The setting-off step comprises: igniting a fuse (8), igniting the lifting-off gunpowder (6), lifting off the pattern-character firework carrier (101), exciting the simultaneous ignition device (5), igniting firework launching gunpowder (10), sending firework display gunpowder (9) out of the carrier, simultaneously igniting the firework display gunpowder (9) in the air, and displaying the pattern and character in the air. The method is simple in implementation, low in cost, and capable of allowing the gunpowder to be combined freely. The sky can be made bright and colorful with the fireworks. Affection can be directly expressed.

4 Claims, 5 Drawing Sheets

(51) Int. Cl.
*F42B 4/30* (2006.01)
*F42B 4/18* (2006.01)

(58) Field of Classification Search
USPC ..... 102/351
See application file for complete search history.

(56) References Cited

U.S. PATENT DOCUMENTS

| | | | | | |
|---|---|---|---|---|---|
| RE38,592 | E * | 9/2004 | Wu | F42B 4/06 | 102/336 |
| 7,100,513 | B2 * | 9/2006 | Gerardi | F42B 4/06 | 102/345 |
| 9,062,943 | B2 * | 6/2015 | Naud | F42B 4/06 | |
| 9,217,624 | B2 * | 12/2015 | Naud | F42B 4/06 | |
| 2005/0217526 | A1 * | 10/2005 | Gerardi | F42B 4/06 | 102/351 |
| 2011/0259229 | A1 * | 10/2011 | Cameron | F42B 4/02 | 102/360 |
| 2013/0255523 | A1 * | 10/2013 | Naud | F42B 4/06 | 102/357 |
| 2017/0052005 | A1 * | 2/2017 | Zheng | F42B 4/30 | |

* cited by examiner

KIND OF IMAGE-TEXT FIREWORK PRODUCTION METHOD

FIELD OF THE INVENTION

The present invention relates to the field of fireworks, especially a method for manufacturing pattern-character fireworks.

BACKGROUND TO THE INVENTION

Nowadays as standard of living rise, entertainment requirement and consumption interest continue to rise. Firework is a product of old brand which lasts for millennia and an enduring one, which adds countless happiness and joy to people. During its spread for one thousand years, numerous types of fireworks have generated and some classic products are created. But with the development of technology, the development of original model has basically came to an end, is difficult to continue and can't keep up with people's needs. New firework products which are more upscale, better looking, easy to generalize and affordable for anyone, are urgently needed in society. In the large events, such as Olympic Games, in order to form the pattern of footprint in the air, countless fireworks were used and a large staff and many computers controlled simultaneously. But this requires plenty of manpower and material resources, high cost, repeatedly coordination and training. So it is hard for people to replicate such process and afford such expense. Today there are some enterprise and individuals who made some try and research in pattern-character firework. These enterprise and individuals include Zhou Zhengjiang, Zhou Zhengkai, Liuyang City Yu technology and environmental protection firework factory, Yu Peichu, Yu Benyou, Liuyang City Da Hu firework art and firework setting off group co., LTD, and Liuyang City celebration fireworks culture group co., LTD and so on. Also They have applied dozens of patents. But their research idea and technology improvements didn't get rid of the original development framework, and there isn't any major breakthrough. In the practical application there are some problems in aspects of manufacturing, packaging and shipping, setting off, and simplifying pattern-character and so on and some defects of high cost, huge volume, inconvenient use, and difficult to be applied, promoted and popularized. The pattern-character firework product which is simple and useful, convenient for manufacture, suitable for efficiency mass production, low in cost, suitable for popularizing, and easy to get and afford, are urgently needed in society.

SUMMARY OF THE INVENTION

The purpose of the present invention is to overcome the above problems existing in the prior art, and to provide a method for manufacturing pattern-character firework which is simple and useful, convenient for manufacture, suitable for efficiency mass production, low in cost, suitable for popularizing, capable of allowing the single firework to be combined freely as needed and then forming various patterns and characters freely. The sky can be made bright and colorful with the fireworks. Affection and celebration can be directly expressed and it is also a way of entertainment and publicity.

To achieve above purpose and reach above result, the present invention is implemented by the following technical solution:

A method for manufacturing pattern-character fireworks comprising: a pattern-character firework carrier which is provided with a lifting-off device and a pattern-character display control device; the lifting-off device arranged under the pattern-character display control device, connected with the pattern-character display control device, and provided with a lifting-off gunpowder bin; the pattern-character display control device provided with a lattice gunpowder packaging body which is provided with multiple firework launching units arranged in lattice, and a simultaneous ignition bin which is provided with the simultaneous ignition device; and the firework launching units connected with the simultaneous ignition device.

Further, the lifting-off gunpowder bin loaded with the lifting-off gunpowder which is connected with the simultaneous ignition device and sealed by a gunpowder isolated bulk at the opening situated beneath the lifting-off gunpowder bin; and the lifting-off gunpowder bin provided with a fuse of which One end connects with the lifting-off gunpowder, and the other end extends outside the lifting-off gunpowder bin.

Further, the lattice gunpowder packaging body provided with multiple firework launching units which are closely arranged in lattice and are independent of each other.

Further, each firework launching unit provided with the firework display gunpowder in the outer position and the firework launching gunpowder in the inner position; the firework display gunpowder sealed by the gunpowder isolated bulk at the outside thereof and connected with the firework launching gunpowder at the inside thereof; and the firework launching gunpowder connected with the simultaneous ignition device.

The pattern-character display method in pattern-character fireworks manufacture comprising the following steps:

- step 1) designing a pattern-character design drawing needed to be displayed;
- step 2) converting the pattern-character design thawing into a color lattice graphic according to the actual lattice arrangement of the firework launching units;
- step 3) arranging the firework display gunpowder of all colors according to the graphic according to color and quantity of the color lattice graphic;
- step 4) loading the firework launching gunpowder into all firework launching units;
- step 5) loading the firework display gunpowder of each color into each firework launching unit according to the color lattice graphic;
- step 6) sealing each firework launching unit having been loaded with the gunpowder isolated bulk.

A method for manufacturing pattern-character fireworks comprising, a setting-off step comprising the following steps:

- step 1) igniting the fuse to ignite the lifting-off gunpowder;
- step 2) lifting off the pattern-character firework carrier into the air with the lifting-off gunpowder launching;
- step 3) exciting the simultaneous ignition device in the simultaneous ignition bin 3 by the lifting-off gunpowder;
- step 4) simultaneously igniting the firework launching gunpowder in the firework launching units by the ignition device according to the predetermined rule;
- step 5) sending the firework display gunpowder out of the pattern-character firework carrier by the firework launching gunpowder ignited in each firework launching unit;

step 6) simultaneously igniting the firework display gunpowder which distributes regularly in lattice in the air and then displaying the pattern-character that was set up in advance in the air.

Further, wherein after the firework display gunpowder has been lifted off, various pattern-character displays in the air; the biggest approximate surface area of the pattern-character is 1-10 square meters; and the launching height of the pattern-character is 3-50 meters.

Further, wherein after the firework display gunpowder has been lifted off, various pattern-character displays in the air; the biggest approximate surface area of the pattern-character is 10-30 square meters; and the launching height of the pattern-character is 10-50 meters.

Further, wherein after the firework display gunpowder has been lifted off, various pattern-character displays in the air; the biggest approximate surface area of the pattern-character is greater than 30 square meters; and the launching height of the pattern-character is 50-150 meters.

The beneficial effect of the invention is that:

1, the present invention is capable of allowing the single pattern-character firework to display the pattern-character designed by a person himself after the firework has been set off as needed;

2, the present invention is capable of allowing the multiple pattern-character fireworks to be combined as needed and to be set off simultaneously or in sequence. The continuous setting-off lasts for a long time. The firework display effect is changing and outstanding;

3, the present invention is reliable, convenient for manufacture, and low in cost. It is suitable for mass production. It meets people's needs that it can be affordable and easy to get;

4, the present invention makes the sky bright and colorful. Affection and celebration can be directly expressed. It is suitable for both entertainment and publicity.

The above description is a summary of the technical solution of the present invention. To understand more clearly the technical solution of the present invention and implement the present invention in accordance with the specification, the preferred embodiment is described in detail as below in conjunction with the drawings. The detailed description of the present invention is provided through the following embodiment and its drawing.

BRIEF DESCRIPTION OF THE FIGURES

The figures described herein are used to make further understanding of the present invention and act as a part of the present invention. The example embodiment and its description of the present invention is used to explain the present invention, but not bring improper limit to the present invention.

Reference numbers in the figures represent: 1, lifting-off gunpowder bin, 2, lattice gunpowder packaging body, 3, simultaneous ignition bin, 4, firework launching unit, 5, simultaneous ignition device, 6, lifting-off gunpowder, 7, gunpowder isolated bulk, 8, fuse, 9, firework display gunpowder, 10, firework launching gunpowder, 11, pattern-character design drawing, 12, color lattice graphic, 13, biggest approximate surface area, 14, launching height, 15, outer packing of the carrier, 16, launching base, 101, pattern-character firework carrier, 201, lifting-off device, 301, pattern-character display control device.

DETAILED DESCRIPTION OF THE INVENTION

The present invention will be described in detail in view of the drawings and implementations.

Figure 1:
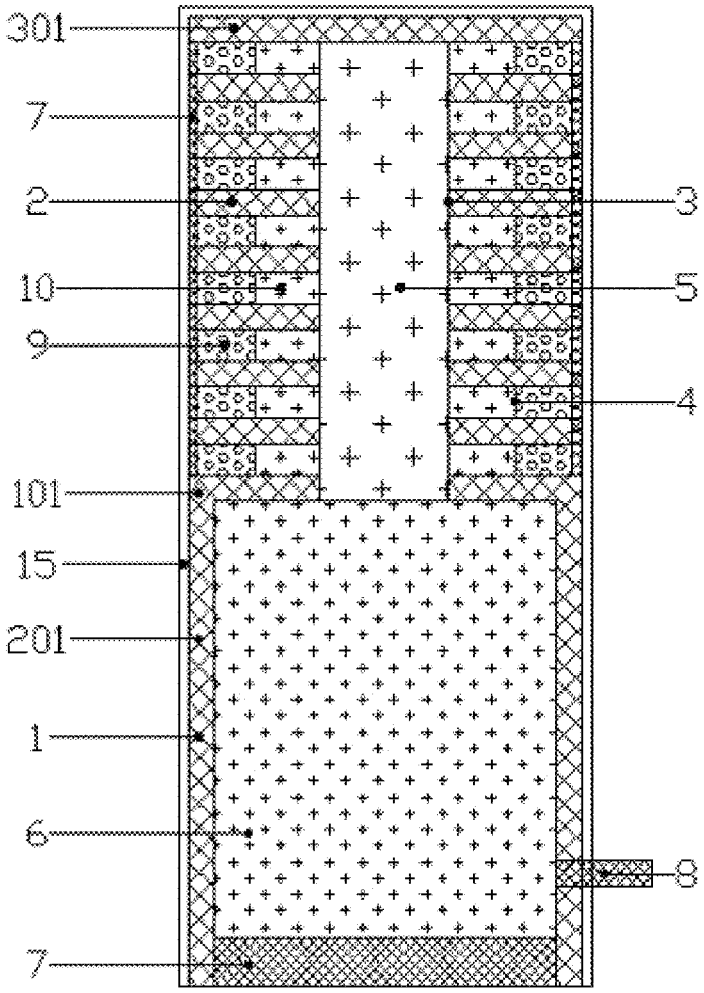
FIG. 1 is a schematic diagram of the pattern-character firework carrier of the present invention.

Referring to FIG. 1, a method for manufacturing pattern-character fireworks comprises a pattern-character firework carrier 101 which is provided with a lifting-off device 201 and a pattern-character display control device 301. The lifting-off device 201 provided with a lifting-off gunpowder bin 1 is arranged under the pattern-character display control device 301 and connected with the pattern-character display control device 301. The pattern-character display control device 301 is provided with a lattice gunpowder packaging body 2 which is provided with multiple firework launching units 4 arranged in lattice, and a simultaneous ignition bin 3 which is provided with the simultaneous ignition device 5. And the firework launching units 4 are connected with the simultaneous ignition device 5.

Further, the lifting-off gunpowder bin 1 is loaded with the lifting-off gunpowder 6 which is connected with the simultaneous ignition device 5 and sealed by a gunpowder isolated bulk 7 at the opening situated beneath the lifting-off gunpowder bin 1. The lifting-off gunpowder bin 1 is provided with fuse 8 of which One end connects with the lifting-off gunpowder 6, and the other end extends outside the lifting-off gunpowder bin 1.

Further, the lattice gunpowder packaging body 2 is provided with multiple firework launching units 4 which are closely arranged in lattice and are independent of each other.

Further, each firework launching unit 4 is provided with the firework display gunpowder 9 in the outer position and the firework launching gunpowder 10 in the inner position. The firework display gunpowder 9 is sealed by the gunpowder isolated bulk 7 at the outside thereof and connected with the firework launching gunpowder (10) at the inside thereof. And the firework launching gunpowder 10 is connected with the simultaneous ignition device 5.

Figure 2:
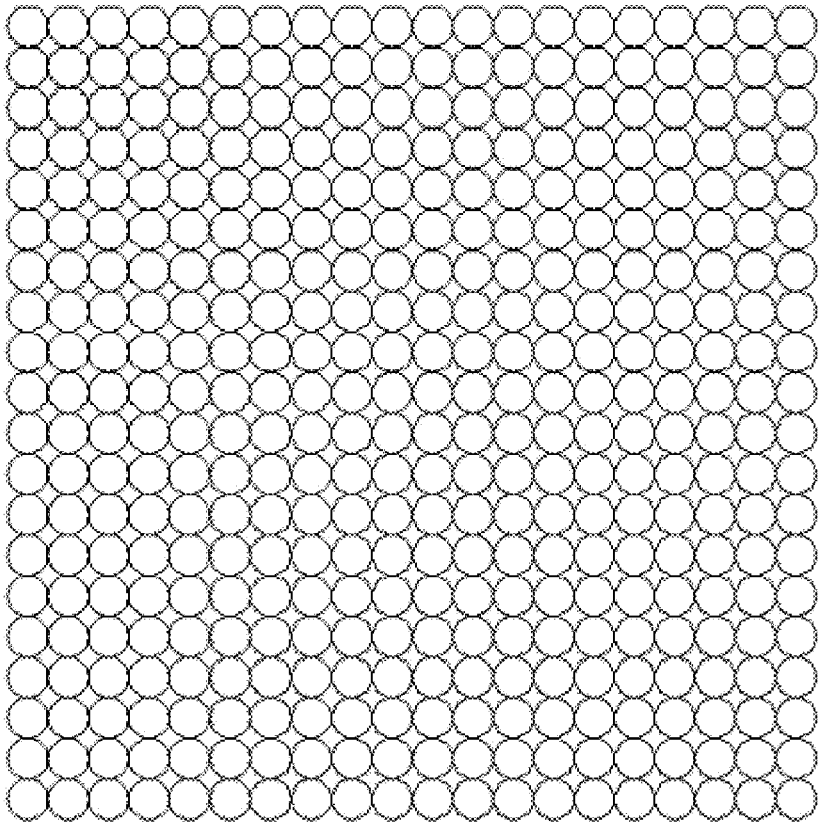
FIG. 2 is a schematic diagram of the lattice of the present invention.

Referring to FIG. 2, a pattern-character display method in pattern-character fireworks manufacture comprises the following steps:

step 1) designing a pattern-character design drawing 11 needed to be displayed;

step 2) converting the pattern-character design drawing 11 into a color lattice graphic 12 according to the actual lattice arrangement of the firework launching units 4;

step 3) arranging the firework display gunpowder 9 of all colors according to the graphic according to color and quantity of the color lattice graphic 12;

step 4) loading the firework launching gunpowder 10 into all firework launching units 4;

step 5) loading the firework display gunpowder 9 of each color into each firework launching unit 4 according to the color lattice graphic 12;

step 6) sealing each firework launching unit 4 having been loaded with the gunpowder isolated bulk 7.

Figure 3:
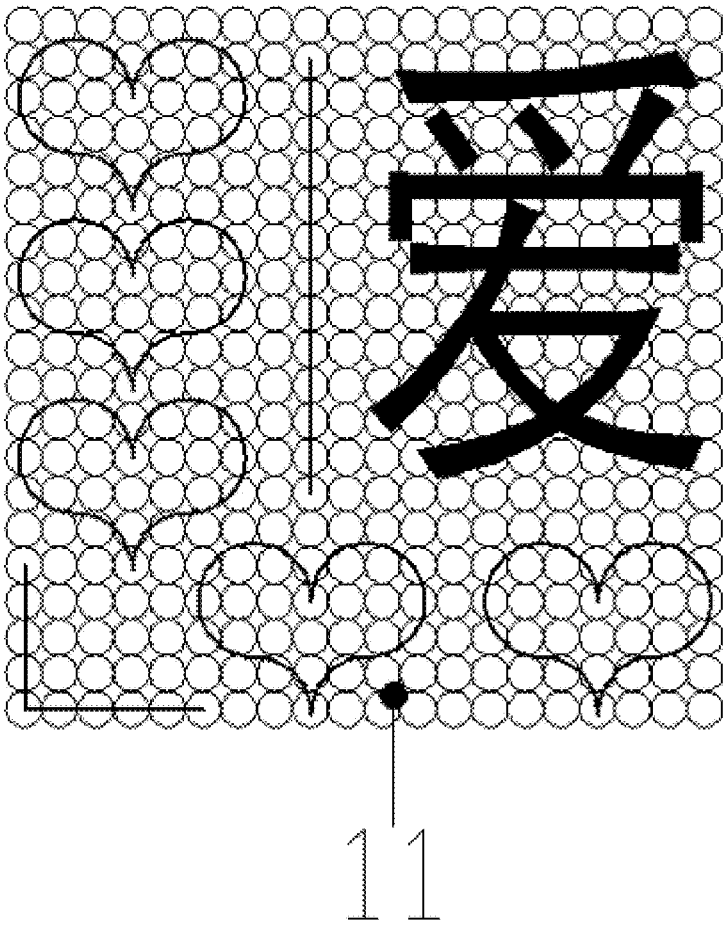
FIG. 3 is a pattern-character design drawing of one embodiment of the present invention.
Figure 4:
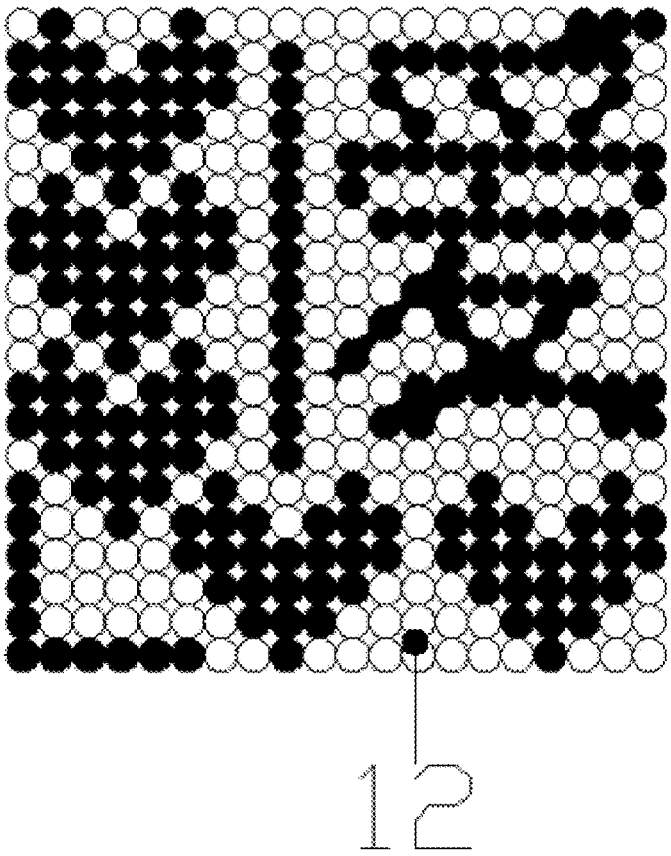
FIG. 4 is a color lattice graphic of one embodiment of the present invention.
Figure 5:
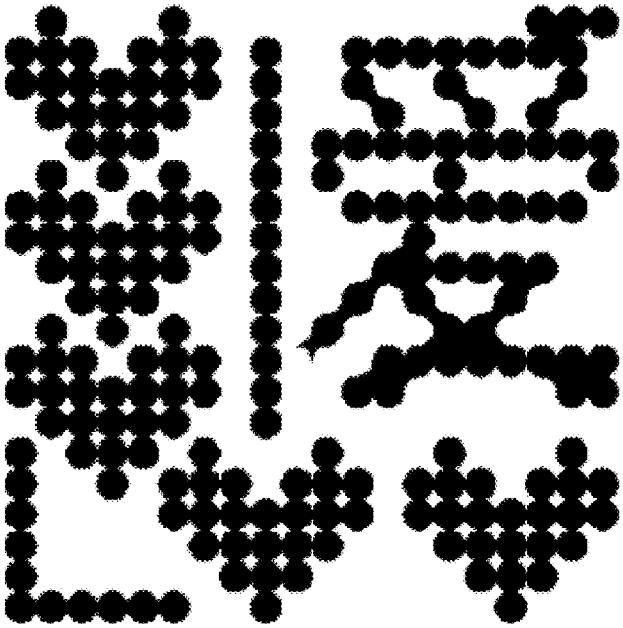
FIG. 5 is a schematic diagram that displays in the air after the pattern-character firework has been launched of one embodiment of the present invention.
Figure 6:
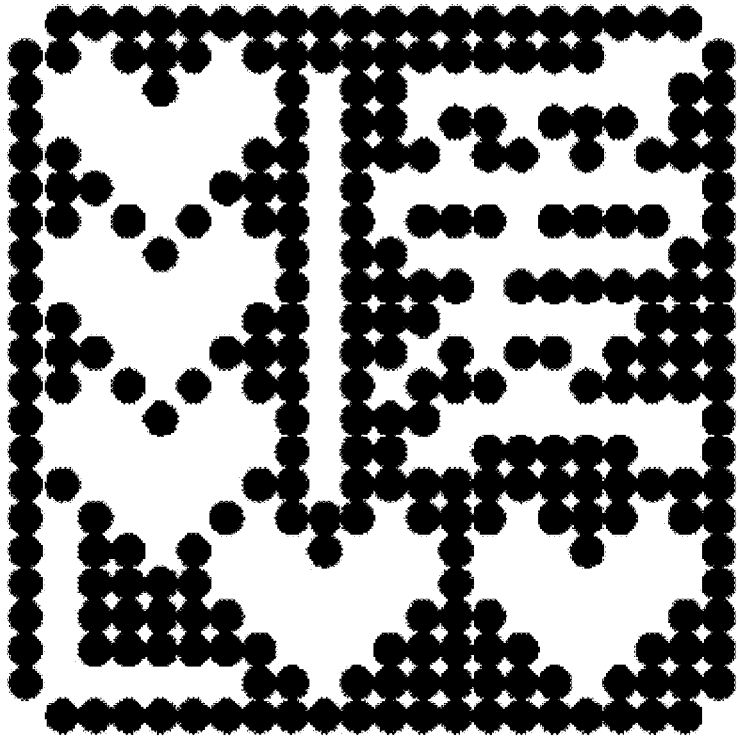
FIG. 6 is a schematic diagram that displays in the air after the pattern-character firework has been launched of one embodiment of the present invention.
Figure 7:
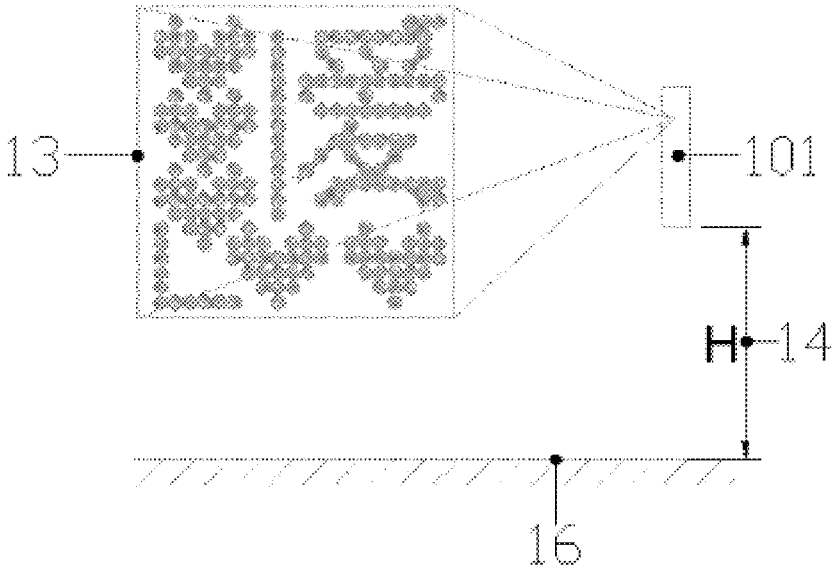
FIG. 7 is a schematic diagram of the relationship between biggest approximate surface area of the pattern-character that displays after the pattern-character firework has been launched and launching height.

Referring to FIG. 3, a method for manufacturing pattern-character fireworks comprises a setting-off step which comprises the following steps:

step 1) step 1 igniting the fuse 8 to ignite the lifting-off gunpowder 6;

step 2) lifting off the pattern-character firework carrier 101 into the air with the lifting-off gunpowder 6 launching;

step 3) exciting the simultaneous ignition device 5 in the simultaneous ignition bin 3 by the lifting-off gunpowder 6;

step 4) simultaneously igniting the firework launching gunpowder 10 in the firework launching units 4 by the ignition device according to the predetermined rule;

step 5) sending the firework display gunpowder 9 out of the pattern-character firework carrier 101 by the firework launching gunpowder 10 ignited in each firework launching unit 4;

step 6) simultaneously igniting the firework display gunpowder 9 which distributes regularly in lattice in the air and then displaying the pattern-character that was set up in advance in the air.

Further, after the firework display gunpowder 9 has been lifted off, various pattern-character displays in the air; the biggest approximate surface area 13 of the pattern-character is 1-10 square meters; and the launching height 14 of the pattern-character is 3-50 meters.

Further, after the firework display gunpowder 9 has been lifted off, various pattern-character displays in the air; the biggest approximate surface area 13 of the pattern-character is 10-30 square meters; and the launching height 14 of the pattern-character is 10-50 meters.

Further, after the firework display gunpowder 9 has been lifted off, various pattern-character displays in the air; the biggest approximate surface area 13 of the pattern-character is greater than 30 square meters; and the launching height 14 of the pattern-character is 50-150 meters.

The embodiment works like this:

An imagined example was used to illustrate that: it is expected to display the pattern-character design drawing 11 as shown in FIG. 2 with the pattern-character fireworks. According to the lattice structure on the pattern-character firework carrier 101, the lattice schematic diagram is painted. Then the lattice schematic diagram is covered by the pattern-character design drawing 11. According to the lattice arrangement of the firework launching units 4, the similar color lattice graphic 12 is made. And according to color and quantity of lattice points of the color lattice graphic 12, all sorts of color and quantity of the firework display gunpowder 9 is arranged. Before loading the work display gunpowder 9, each firework launching unit 4 is loaded with the firework launching gunpowder 10. Then each of the firework display gunpowder 9 corresponds to one color according to the color lattice graphic 12. and each firework launching unit 4 is loaded with the firework display gunpowder 9 of each color. After having been loaded, each firework launching unit 4 is sealed with the gunpowder isolated bulk 7. Then the simultaneous ignition device 5 is installed into the simultaneous ignition bin 3. The lifting-off gunpowder bin 1 is loaded with the lifting-off gunpowder 6 with the fuse extending outside the lifting-off gunpowder bin 1. After having been loaded, the lifting-off gunpowder bin 1 is sealed by the gunpowder isolated bulk 7. At last, the fireworks is packed with outer packing of the carrier 15 and can be transported and sold as a product. When setting off, user puts the pattern-character firework on the launching base 16 and ignites the fuse to ignite the lifting-off gunpowder 6, so that the pattern-character firework is launched into the air. For the convenience of watching the firework, the biggest approximate surface area that the pattern-character firework displays is greatly connected with the launching height. When the pattern-character firework lifts off too much, the pattern-character will appear quite small; when it lifts off too low, the pattern-character will be incomplete or the firework will bring dangerous. After the pattern-character firework has been launched, the firework display gunpowder 9 is lifted off at the right height according to the biggest approximate surface area that the pattern-character firework displays 13. The sky can be made bright and colorful. The predetermined pattern-character is displayed as expected. Affection can be directly expressed. And the method is suitable for both entertainment and publicity.

The above description is just the preferred embodiment of the present invention, but doesn't limit the present invention. To the person skilled in the art, various modifications and changes may be made. Any modification, improvement and equivalent alternative based on the spirit and the principle of the present invention should be covered within the scope of the claims.

What is claimed is:

1. A method for manufacturing pattern-character fireworks comprising: a pattern-character firework carrier (101) which is provided with a lifting-off device (201) and a pattern-character display control device (301); the lifting-off device (201) arranged under the pattern-character display control device (301), connected with the pattern-character display control device (301), and provided with a lifting-off gunpowder bin (1); the pattern-character display control device (301) provided with a lattice gunpowder packaging body (2) which is provided with multiple firework launching units (4) arranged in lattice, and a simultaneous ignition bin (3) which is provided with the simultaneous ignition device (5); and the firework launching units (4) connected with the simultaneous ignition device (5).

2. The method for manufacturing pattern-character fireworks of claim 1 comprising: the lifting-off gunpowder bin (1) loaded with the lifting-off gunpowder (6) which is connected with the simultaneous ignition device (5) and sealed by a gunpowder isolated bulk (7) at the opening situated beneath the lifting-off gunpowder bin (1); and the lifting-off gunpowder bin (1) provided with a fuse (8) of which One end connects with the lifting-off gunpowder (6), and the other end extends outside the lifting-off gunpowder bin (1).

3. The method for manufacturing pattern-character fireworks of claim 1 comprising: the lattice gunpowder packaging body (2) provided with multiple firework launching units (4) which are closely arranged in lattice and are independent of each other.

4. The method for manufacturing pattern-character fireworks of claim 3 comprising, each firework launching unit (4) provided with the firework display gunpowder (9) in the outer position and the firework launching gunpowder (10) in the inner position; the firework display gunpowder (9) sealed by the gunpowder isolated bulk (7) at the outside thereof and connected with the firework launching gunpowder (10) at the inside thereof; and the firework launching gunpowder (10) connected with the simultaneous ignition device (5).

* * * * *